US007420524B2

(12) United States Patent
Werner et al.

(10) Patent No.: US 7,420,524 B2
(45) Date of Patent: Sep. 2, 2008

(54) PIXELIZED FREQUENCY SELECTIVE SURFACES FOR RECONFIGURABLE ARTIFICIAL MAGNETICALLY CONDUCTING GROUND PLANES

(75) Inventors: Douglas H. Werner, State College, PA (US); Thomas N. Jackson, State College, PA (US); Gareth J. Knowles, Williamsport, PA (US)

(73) Assignee: The Penn State Research Foundation, University Park, PA (US)

( * ) Notice: Subject to any disclaimer, the term of this patent is extended or adjusted under 35 U.S.C. 154(b) by 294 days.

(21) Appl. No.: 10/821,765

(22) Filed: Apr. 9, 2004

(65) Prior Publication Data

US 2004/0263420 A1 Dec. 30, 2004

Related U.S. Application Data

(60) Provisional application No. 60/462,719, filed on Apr. 11, 2003.

(51) Int. Cl.
*H01Q 15/02* (2006.01)

(52) U.S. Cl. ..... 343/909; 343/700 MS

(58) Field of Classification Search ..... 343/909, 343/700 MS, 753, 750, 846, 848, 912, 834, 343/754, 756, 876, 853, 755
See application file for complete search history.

(56) References Cited

U.S. PATENT DOCUMENTS 5,579,024 A * 11/1996 Sureau ..... 343/909
6,028,692 A 2/2000 Rhoads et al. ..... 359/245
6,307,519 B1 10/2001 Livingston et al. ..... 343/767
6,417,807 B1 7/2002 Hsu et al. ..... 343/700 MS
6,448,936 B2 9/2002 Kopf et al. ..... 343/767
6,469,677 B1 10/2002 Schaffner et al. ..... 343/876
6,483,480 B1 11/2002 Sievenpiper et al. ..... 343/909
6,501,427 B1 * 12/2002 Lilly et al. ..... 343/700 MS
6,512,494 B1 1/2003 Diaz et al. ..... 343/909

(Continued)

FOREIGN PATENT DOCUMENTS

GB 2 253 519 A 9/1992
WO WO 94/00892 A1 1/1994
WO WO 02/089256 A1 11/2002

OTHER PUBLICATIONS

D. Sievenpiper, L. Zhang, R. Broas, N. Alexopolous, E. Yablonovitch, "High-Impedance Electromagnetic Surfaces with a Forbidden Frequency Band," IEEE Transactions on Microwave Theory and Techniques, vol. 47, No. 11, Nov. 1999 (pp. 2059-2074).

(Continued)

*Primary Examiner*—HoangAnh T Le
(74) *Attorney, Agent, or Firm*—Gifford, Krass, Sprinkle, Anderson & Citkowski, PC

(57) ABSTRACT

A reconfigurable frequency selective surface (FSS) includes a plurality of conducting patches supported on the surface of a dielectric layer, with selectable electrical interconnections between the conducting patches so as to provide a desired characteristic. The reconfigurable FSS can be used in a reconfigurable artificial magnetic conductor (AMC). A reconfigurable AMC includes a dielectric layer, a conducting backplane on one surface of the dielectric layer, and a reconfigurable FSS on the other surface of the dielectric layer. A reconfigurable AMC can be used as a dynamically reconfigurable ground plane for a low-profile antenna system.

25 Claims, 7 Drawing Sheets

U.S. PATENT DOCUMENTS

| | | | | |
|---|---|---|---|---|
| 6,525,695 | B2 * | 2/2003 | McKinzie, III | 343/756 |
| 6,526,695 | B1 | 3/2003 | Nguyen | 49/141 |
| 6,650,291 | B1 | 11/2003 | West et al. | 342/371 |
| 6,690,327 | B2 | 2/2004 | McKinzie, III et al. | 343/700 MS |
| 6,885,345 | B2 * | 4/2005 | Jackson | 343/700 MS |
| 2001/0036217 | A1 | 11/2001 | Kopf et al. | 372/92 |
| 2002/0167456 | A1 | 11/2002 | McKinzie, III et al. | 343/909 |
| 2002/0167457 | A1 | 11/2002 | McKinzie, III et al. | 343/909 |
| 2003/0112186 | A1 | 6/2003 | Sanchez et al. | 343/700 MS |
| 2004/0001021 | A1 | 1/2004 | Choo et al. | 343/700 MS |

OTHER PUBLICATIONS

F. Yang, K. Ma, Y. Qian, T. Itoh, "A Uniplanar Compact Photonic-Bandgap (UC-PBG) Structure and Its Applications for Microwave Circuits," IEEE Transactions on Microwave Theory and Techniques, vol. 47, No. 8, Aug. 1999 (pp. 1509-1514).

D. Kern and D. Werner, "A Genetic Algorithm Approach to the Design of Ultra-Thin Electromagnetic Bandgap Absorbers," Microwave and Optical Technology Letters, vol. 38, No. 1, Jul. 5, 2003 (pp. 61-64).

D. Werner, D. Kern, P. Werner, M. Wilhelm, A. Monorchio, L. Lanuzza, "Advances in the Design Synthesis of Electromagnetic Bandgap Metamaterials," Progress in Electromagnetics Symposium 2003, Hawaii, Oct. 13-16.

D. Kern, D. Werner, M. Wilhelm, K. Church, "Genetically Engineered Multiband High-Impedance Frequency Selective Surfaces," Microwave and Optical Technology Letters, vol. 38, No. 5, Sep. 5, 2003 (pp. 400-403).

G. Legg, "Embedded Antennas Get the Signal," www.edn.com, Aug. 8, 2002.

* cited by examiner

FIG - 6
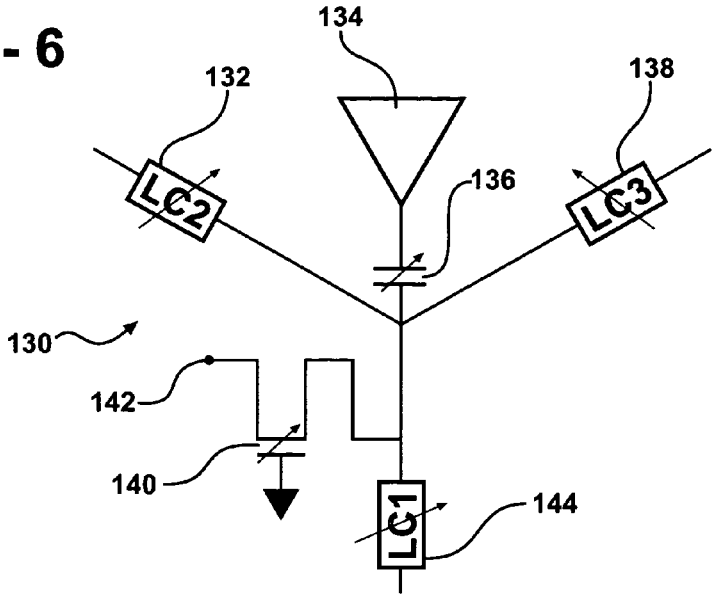
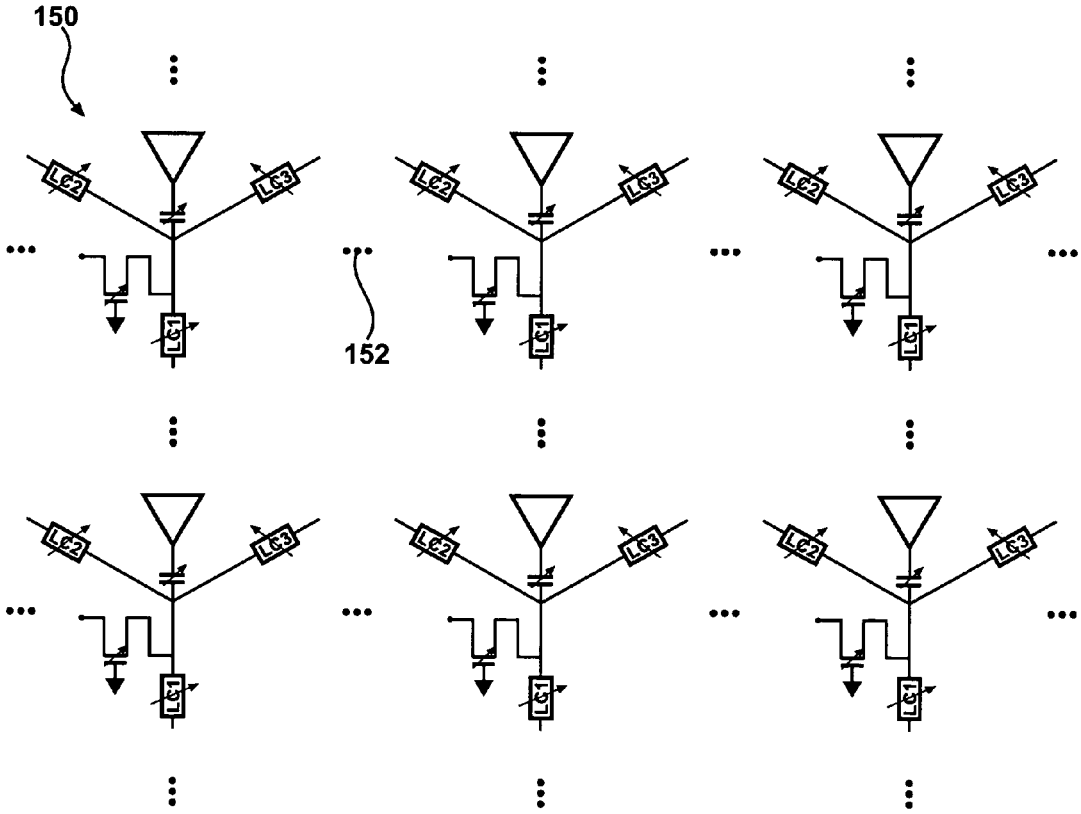
FIG - 7

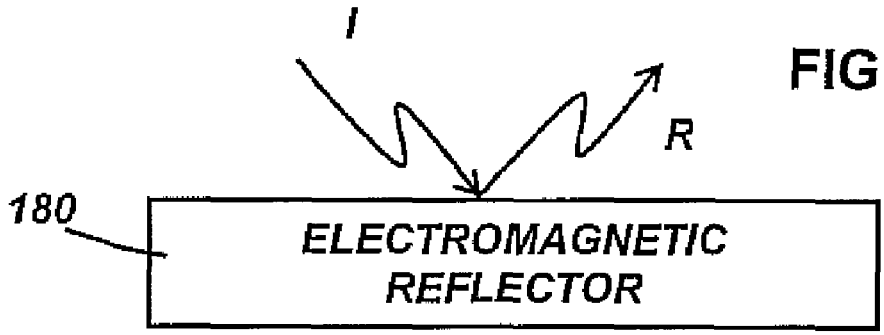
FIG - 8A
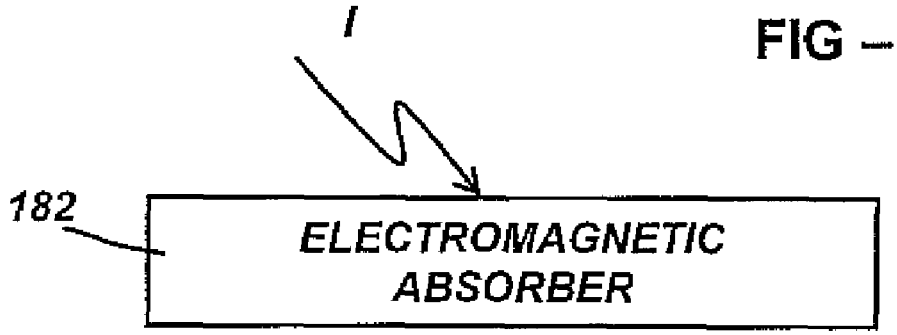
FIG – 8B
FIG – 8C
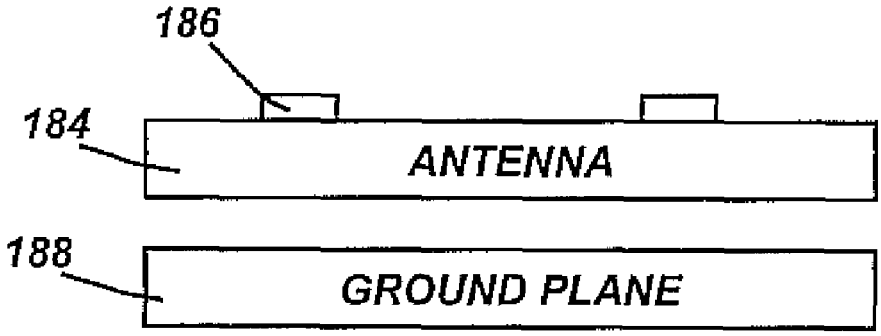

PIXELIZED FREQUENCY SELECTIVE SURFACES FOR RECONFIGURABLE ARTIFICIAL MAGNETICALLY CONDUCTING GROUND PLANES

REFERENCE TO RELATED APPLICATION

This application claims priority to provisional application U.S. Ser. No. 60/462,719, filed Apr. 11, 2003, the entire content of which is incorporated herein by reference.

FIELD OF THE INVENTION

The present invention relates to reconfigurable frequency selective surfaces, in particular for use in reconfigurable artificial magnetic conductors for use as ground planes for antennas.

BACKGROUND OF THE INVENTION

Electrically conducting metallic ground planes have been successfully used for many years in the design of a wide variety of antenna systems. However, there are several major drawbacks associated with using conventional metallic ground planes for antenna applications. These include the fact that 1) horizontally polarized antennas, such as dipoles, must be placed at least a quarter-wavelength above the ground plane in order to achieve optimal performance, and 2) ground planes of this type are known to support surface waves, which are undesirable in many antenna applications.

Recently the concept of an artificial magnetic conductor (AMC) ground plane was introduced as a means of mitigating many of the problems associated with the use of conventional electrically conducting ground planes.

The term artificial magnetic conductor (AMC) typically refers to a structure comprising a dielectric layer having a conducting sheet on one surface and a frequency selective surface (FSS) on the other surface. The FSS is typically an array of conducting patterns supported by a non-conducting surface (the surface of the dielectric layer).

An individual conducting pattern, repeated over the surface of the FSS, may be referred to as a unit cell of the FSS. Conventionally, the unit cell is repeated without variation over the FSS. Typically, the unit cell is a square conducting patch repeated in a grid pattern, for example as described in U.S. Pat. No. 6,525,695 to McKinzie et al. However, more complex shapes are possible.

At a resonance frequency, the AMC behaves as a perfect magnetic conductor, and reflected electromagnetic waves are in phase with the incident electromagnetic waves. This effect is useful in increasing the radiated output energy of an antenna, as radiation emitted backwards from the antenna can be reflected in phase from an AMC backplane, and hence can contribute to the forward emitted radiation, as any interference will be constructive. Hence, the term AMC is given to a multi-component structure providing the properties of a magnetic conductor at one or more frequencies.

Conventional AMC technology is described by D. Sievenpiper, et al., *IEEE Trans. Microwave Theory Tech.*, vol. MTT-47, pp. 2059-2074, November 1999 and F. Yang, et al., pp. 1509-1514, August 1999. Thin AMC ground planes with thicknesses on the order of 1/100 or less of the electromagnetic wavelength can be effectively used to design low-profile horizontally polarized dipole antennas. The use of an AMC in this case allows the antenna height to be considerably reduced to the point where it is nearly on top of the AMC surface. In addition, AMC ground planes also possess the added advantage of being able to suppress undesirable surface waves.

While the conventional AMC ground planes can enhance the performance of many commonly used antennas, they are typically narrow-band and lack the flexibility required for use in low-profile frequency-agile antenna systems.

U.S. Pat. No. 6,483,480 to Sievenpiper et al. describes a tunable impedance surface having a ground plane and two arrays of elements, the one array moveable relative to the other. Int. Pat. Pub. No. WO94/00892 and GB Pat. No. 2,253,519, both to Vardaxoglou, describe a reconfigurable frequency selective surface in which a first array of elements is displaced relative to a second array. U.S. Pat. No. 6,690,327 to McKinzie et al. describes a mechanically reconfigurable AMC. However, mechanical reconfiguration of an array of elements can be difficult to implement.

U.S. Pat. No. 6,469,677 to Schaffner et al. describes the use of micro-electromechanical system (MEMS) switches within a reconfigurable antenna. U.S. Pat. Nos. 6,417,807 to Hsu et al. and U.S. Pat. No. 6,307,519 to Livingston et al. also describe MEMS switches within an antenna. U.S. Pat. No. 6,448,936 to Kopf et al. describes a reconfigurable resonant cavity with frequency selective surfaces and shorting posts. However, these patents are not directed towards a reconfigurable AMC.

U.S. Pat. No. to 6,525,695 and U.S. Pat. App. Pub. No. 2002/0167456, both to McKinzie, describe a reconfigurable AMC having voltage controlled capacitors with a coplanar resistive biasing network. U.S. Pat. No. 6,512,494 to Diaz et al. describes multi-resonant high-impedance electromagnetic surfaces, for example for use in an AMC. Int. Pat. Pub. No. WO02/089256 to McKinzie et al., U.S. Pat. App. Pub. No. 2003/0112186 to Sanchez et al., and U.S. Pat. App. Pub. No. 2002/0167457 to McKinzie et al. describe the control of the sheet capacitance of a reconfigurable AMC. U.S. Pat. No. 6,028,692 to Rhoads et al. describes a tunable surface filter having a controllable element having an end-stub.

Approaches described in the prior art may allow the tuning of a resonance frequency of an AMC, but may not allow the change of other parameters such as resonance width, or allow reconfiguration of multiple band AMCs. Typically, adjustments are made over the whole surface of the AMC, not allowing for local adjustments. Also, reconfigurable pixel configurations are not disclosed.

Patents and published U.S. patent applications referenced in this application are incorporated herein by reference. Co-pending U.S. patent applications to one or more of the present inventors are also incorporated herein by reference, including: U.S. application Ser. No. 10/755,539, filed Jan. 12, 2004, to Werner (concerning metaferrite properties of an AMC); U.S. application Ser. No. 10/625,158, filed Jul. 23, 2003 (concerning fractile antenna arrays); and U.S. application Ser. No. 10,712,666, filed Nov. 13, 2003, to Jackson (concerning a reconfigurable pixelized antenna system).

FIGS. 8A and 8B show an electromagnetic reflector and electromagnetic absorber, respectively. The electromagnetic reflector 180 tends to reflect electromagnetic radiation. The incident radiation is indicated as wavy arrowed line I, and the reflected radiation is indicated by wavy arrowed line R. The electomagnetic absorber 182 tends to absorb electromagnetic radiation, there being no reflected radiation R shown. FIG. 8C shows an antenna 184, having radiative elements 186, and antenna backplane 188. The electromagnetic reflector, electromagnetic absorber, and antenna ground plane are useful components known in the art, and improved devices would allow improved properties.

BRIEF DESCRIPTION OF THE FIGURES

FIG. 6 illustrates a radiative element of an antenna, which can be used in conjunction with a reconfigurable AMC;

FIG. 7 illustrates part of a reconfigurabile array of radiative elements of an antenna, which can be used in conjunction with a reconfigurable AMC; and FIGS. 8A, 8B and 8C show an electromagnetic reflector, electromagnetic absorber, and ground plane of an antenna, respectively.

SUMMARY OF THE INVENTION

A reconfigurable frequency selective surface (FSS) allows adjustment and control of frequency-dependent electromagnetic properties. In one example, a multi-pixel FSS has selectable interconnections between conducting patches so as to provide a desired pattern of interconnected conducting patches, allowing one or more desired electromagnetic characteristics to be achieved.

The reconfigurable FSS can be used in a reconfigurable artificial magnetic conductor (AMC). By pixelizing the frequency selective surface (FSS) used in the AMC, the AMC can be dynamically reconfigured for operation at one or more desired frequencies. The use of such reconfigurable AMCs as antenna ground planes facilitates the design of low-profile reconfigurable antenna systems.

DETAILED DESCRIPTION OF THE INVENTION

A reconfigurable FSS can be realized by interconnecting a matrix of electrically conducting patches using a plurality of switches that can be individually turned on and off to produce arbitrary periodic conducting patterns. For example, an N×N matrix of conducting patches can be arranged in a grid pattern, with switches provided so as to selectively electrically interconnect neighboring patches. This approach can be used to provide a reconfigurable AMC, which may be used as an improved antenna ground plane.

Figure 1:
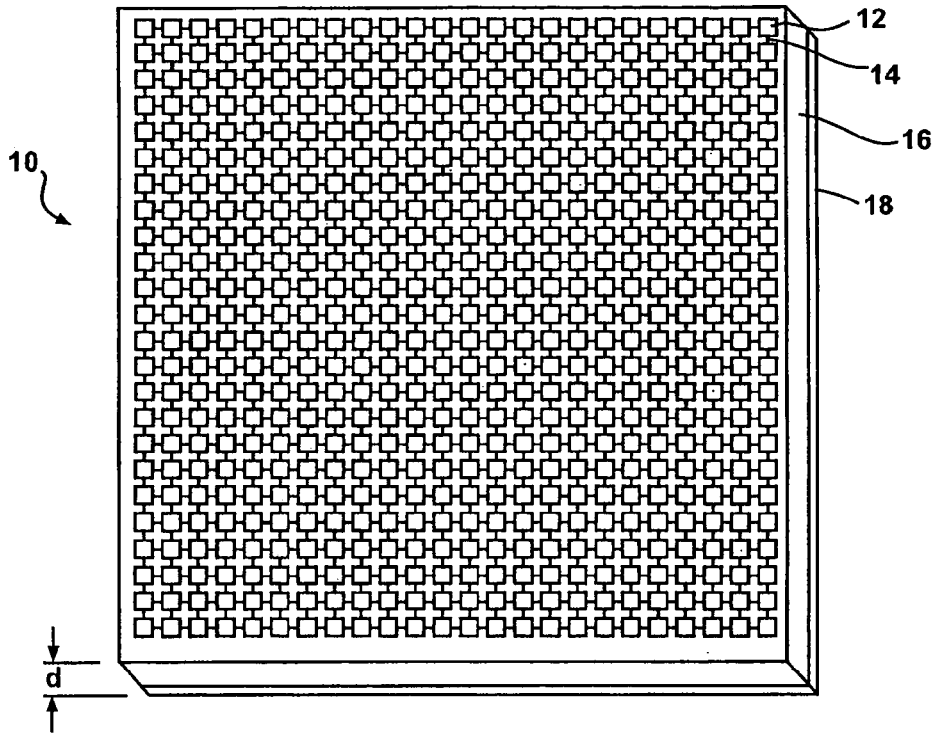
FIG. 1 illustrates a possible layout for a reconfigurable artificial magnetic conductor (AMC)

FIG. 1 shows an example of a reconfigurable AMC, shown generally at 10, comprising a pixelized FSS on the top of a dielectric layer 16 (having dielectric thickness d) backed by an electrical conductor (such as a metallic sheet) 18. The pixelized FSS comprises a plurality of conducting patches (which may be termed pixels) such as 12, interconnected by switches. FIG. 1 shows all conducting patches interconnected with neighboring patches through a square grid of closed switches, shown as lines such as 14. Switches may be deselected (opened) so as to remove the electrical interconnection between the patches through the switch.

Figure 2A:
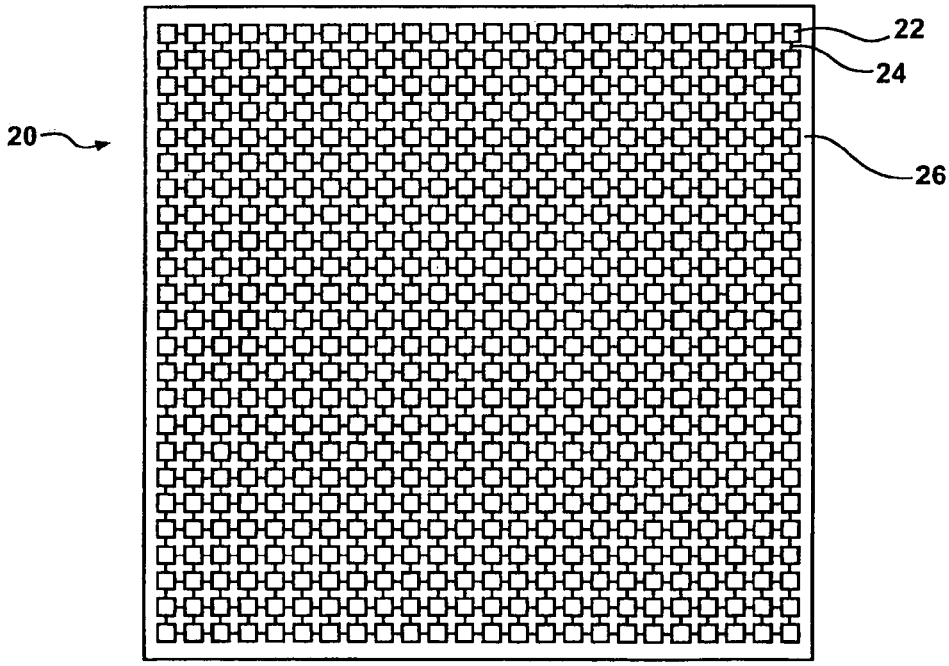
FIGS. 2A and 2B further illustrate a possible layout for a reconfigurable AMC.
Figure 2B:
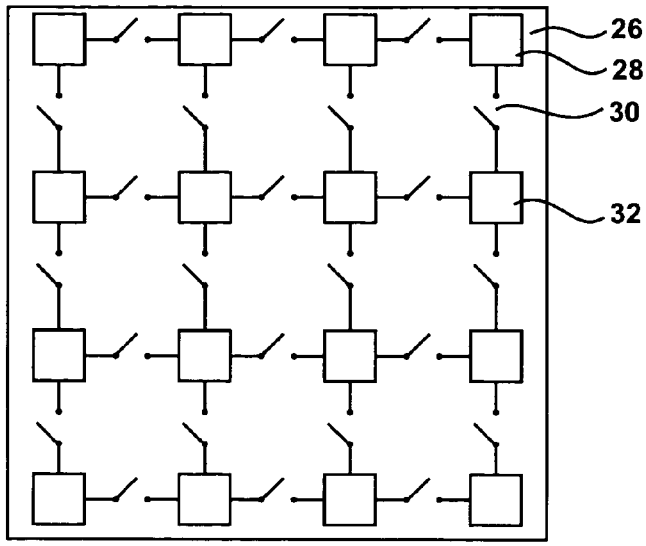

FIGS. 2A and 2B show another example of a reconfigurable AMC. FIG. 2A shows a top view of a reconfigurable AMC shown generally at 20 looking down on the pixelized FSS, including conducting patches such as 22 and switches such as 24 on the top surface 26 of a dielectric slab.

FIG. 2B shows an expanded view of a 4×4 matrix of conducting patches (or pixels) such as 28 and 32 located on one surface of dielectric slab 26, showing a schematic representation of an open switch such as 30. If switch 30 is closed, this can be represented as a line such as 24 on FIG. 2A.

Figure 3A:
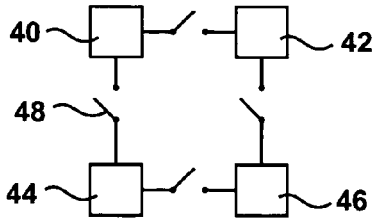
FIGS. 3A, 3B, and 3C illustrate possible approaches to inter-pixel switching.
Figure 3B:
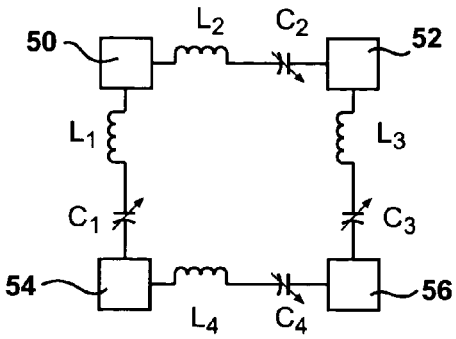
Figure 3C:
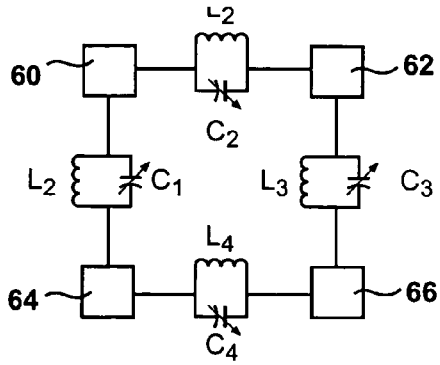

FIGS. 3A-3C illustrate approaches to providing inter-pixel switches. FIG. 3A is a general representation showing individual pixels 40, 42, 44, and 46 interconnected by switches such as 48. FIG. 3B illustrates pixels 50, 52, 54, and 56 interconnected by switches provided by series-connected reactive LC loads. Here, L represents an inductor and C represents a capacitor. FIG. 3C illustrates pixels 60, 62, 64, and 66 interconnected by switches represented as parallel-connected reactive LC loads.

A reactive LC load can be designed so as to substantially act as a short circuit (i.e., a closed switch) over a certain predetermined range or ranges of frequencies, and to substantially act as an open circuit (i.e., an open switch) over another range or ranges of frequencies.

Variable capacitors may be used to provide further frequency agility in the design of reactive LC loads. For example, variable capacitors allow the tuning of the resonance frequency of the loads thereby effectively changing the frequency at which they act as open and/or short circuits. This capability provides even greater flexibility in the design of the reconfigurable AMC ground planes. Variable capacitors may include electrically tunable dielectric elements.

FIG. 4A-4D illustrate a possible design of a reconfigurable four-band AMC ground plane. The high-band configuration is resonant at a resonance frequency $f=f_1$, the two bands in the middle are resonant at $f=f_2=f_1/2$ and $f=f_3=f_1/3$, while the low-band is resonant at $f=f_4=f_1/4$.

Figure 4A:
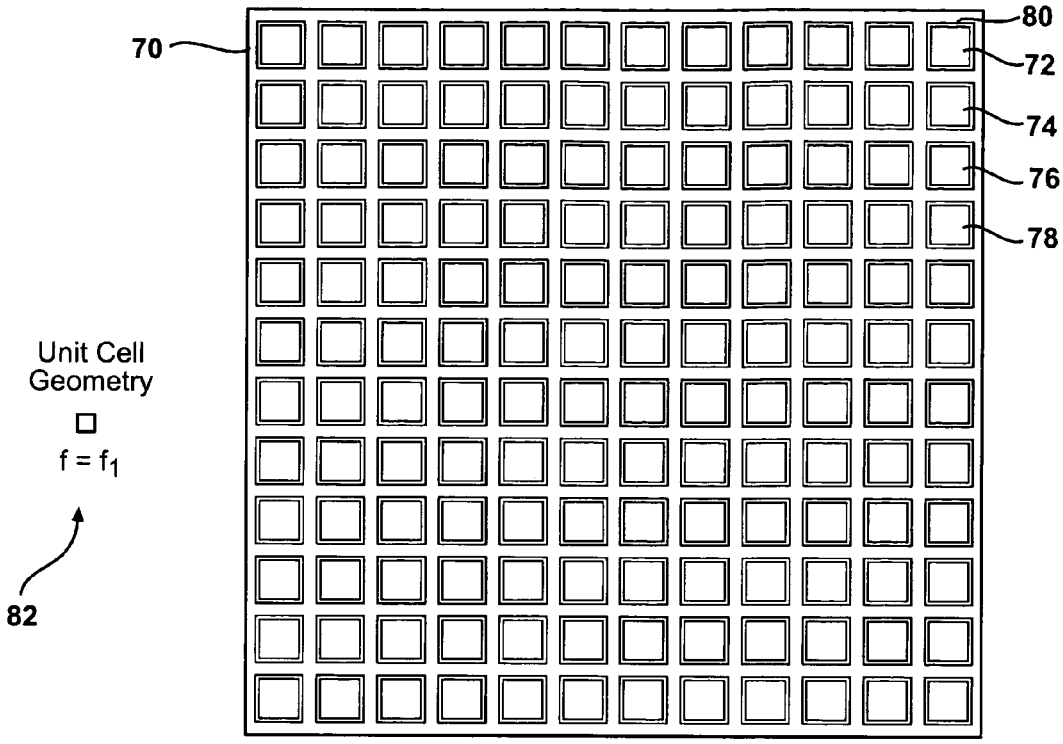
FIGS. 4A, 4B, 4C, and 4D illustrate how the resonance frequency of an AMC changes in different interconnection configurations.

FIG. 4A shows the FSS unit cell configured for the highest band of operation where $f=f_1$, along with a 12×12 portion of the pixelized FSS screen supported on the surface 70 of a dielectric slab. The unit cell, illustrated at 82, comprises a single pixel, for example a pixel such as 72, 74, 76, or 78. A band 80 around each pixel further highlights the extent of the unit cell; this band is for illustratative purposes only, and does not represent a real physical structure. For this highband state, proper operation of the reconfigurable AMC ground plane requires all switches to be open. Hence, there are no lines indicating an electrical interconnection between any two pixels.

Figure 4B:
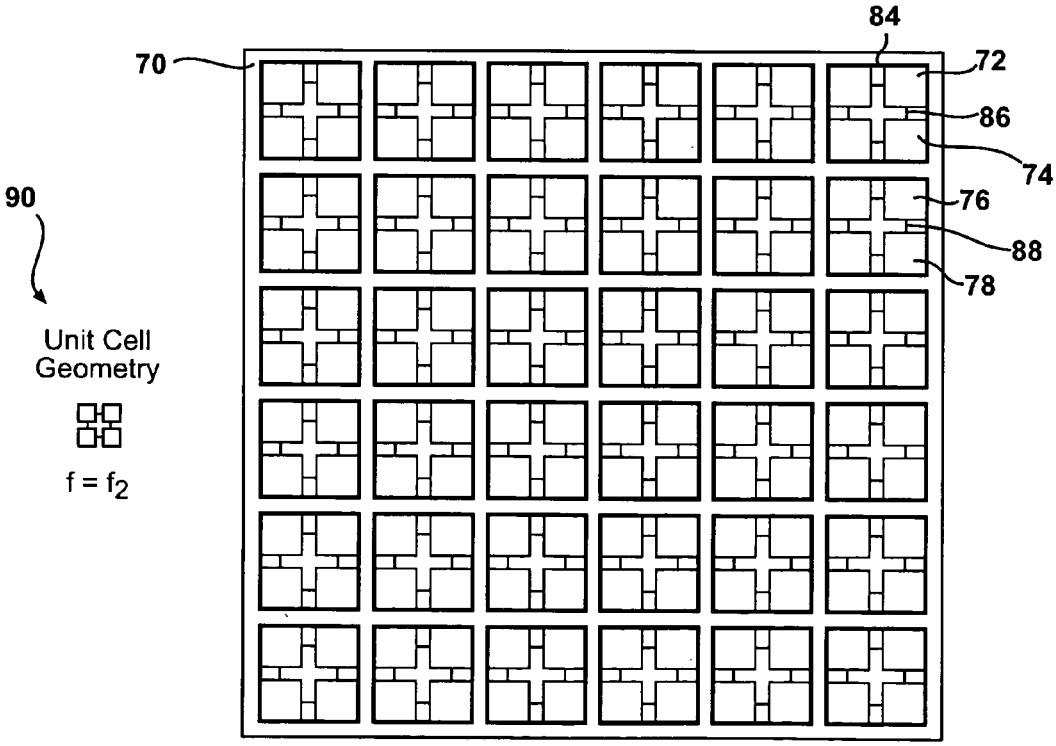

FIG. 4B shows the unit cell 90 for a reconfigurable state consisting of a 2×2 matrix of interconnected pixels. A 6×6 unit cell portion of the corresponding pixelized FSS is also shown, which has a resonance frequency of $f=f_2=f_1/2$. The band 84 further illustrates the extent of the unit cell within the pixelized FSS, and does not indicate a real physical structure. Closed switches, such as 86 and 88, provide electrical interconnection between adjacent pixels, in this case between pixels 72 and 74, and between pixels 76 and 78, respectively.

Figure 4C:
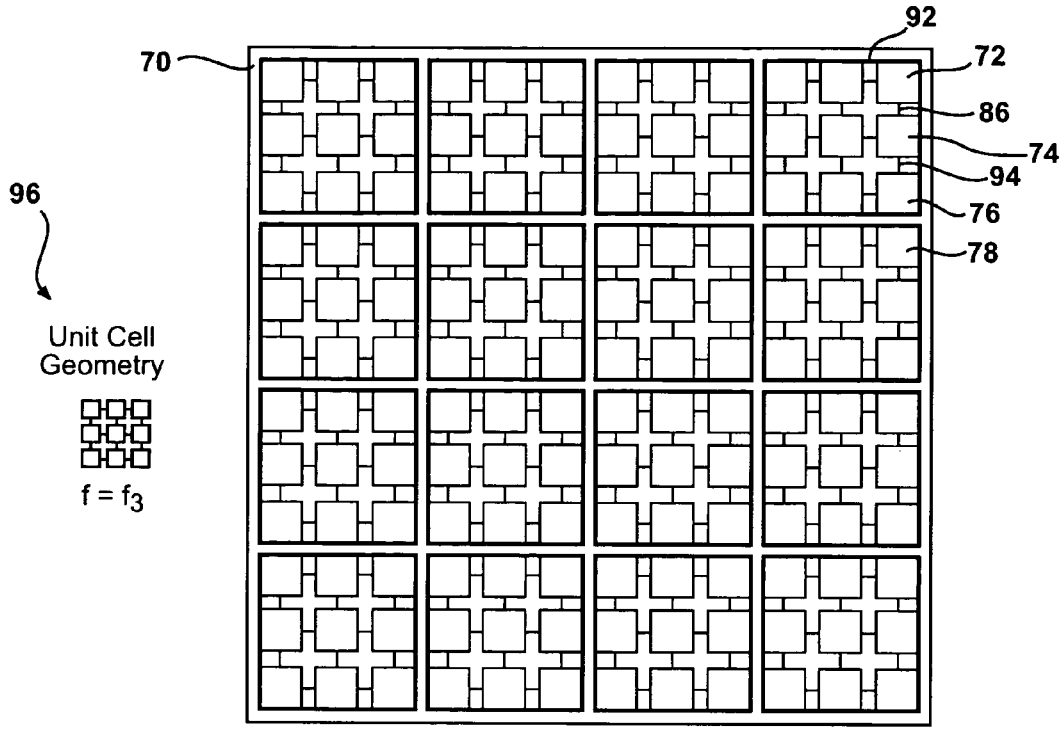

FIG. 4C shows a unit cell 96 composed of a 3×3 matrix of interconnected pixels. FIG. 4C also shows a 4×4 unit cell portion of the corresponding pixelized FSS screen with an operating frequency of $f=f_3=f_1/3$. Band 92 further illustrates the extent of the unit cell within the pixelized FSS, and does not indicate a real physical structure. Pixels are interconnected in groups of 9. For example, pixel 72 is interconnected with pixel 74 through closed switch 86, and pixel 74 is interconnected with pixel 76 through closed switch 94. However, in this configuration there is no electrical interconnection between pixels 76 and 78.

Figure 4D:
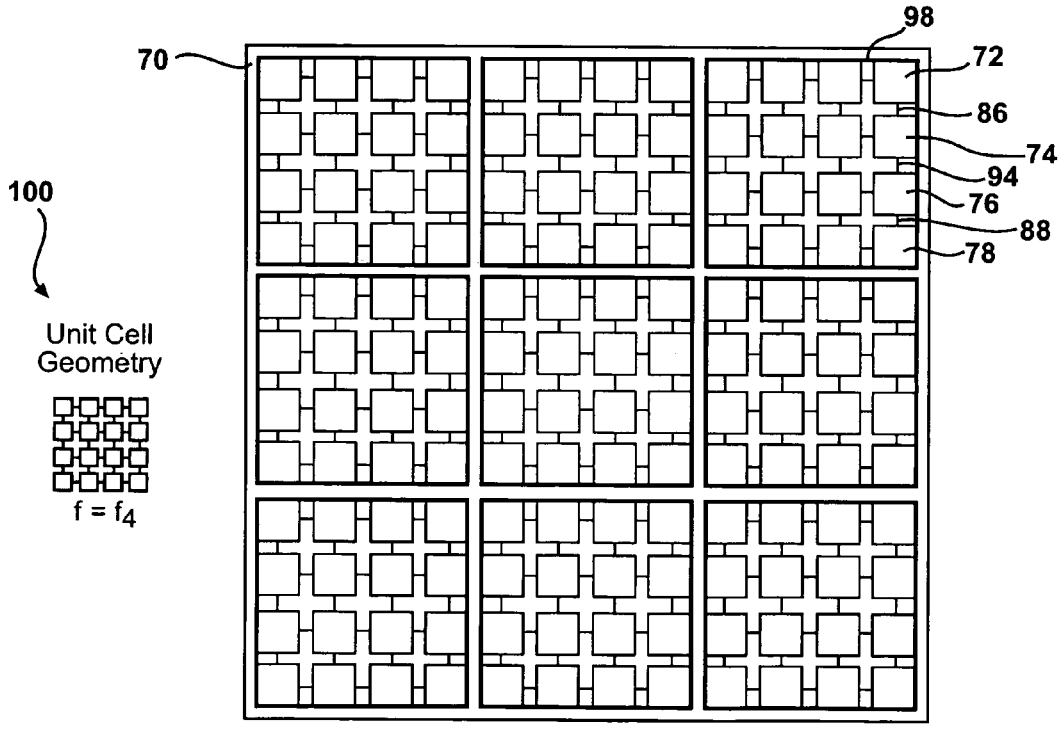

FIG. 4D shows a 4×4 matrix of interconnected pixels, the FSS unit cell 100 for the lowest band of operation centered at $f=f_4=f_1/4$. FIG. 4D shows a 3×3 unit cell portion of the corresponding FSS for the lowband state. Here, pixels 72, 74, 76, and 78 are electrically interconnected using closed switches 86, 94, and 88. Band 98 further illustrates the extent of the unit cell within the FSS, and does not indicate a real physical structure.

Figure 5A:
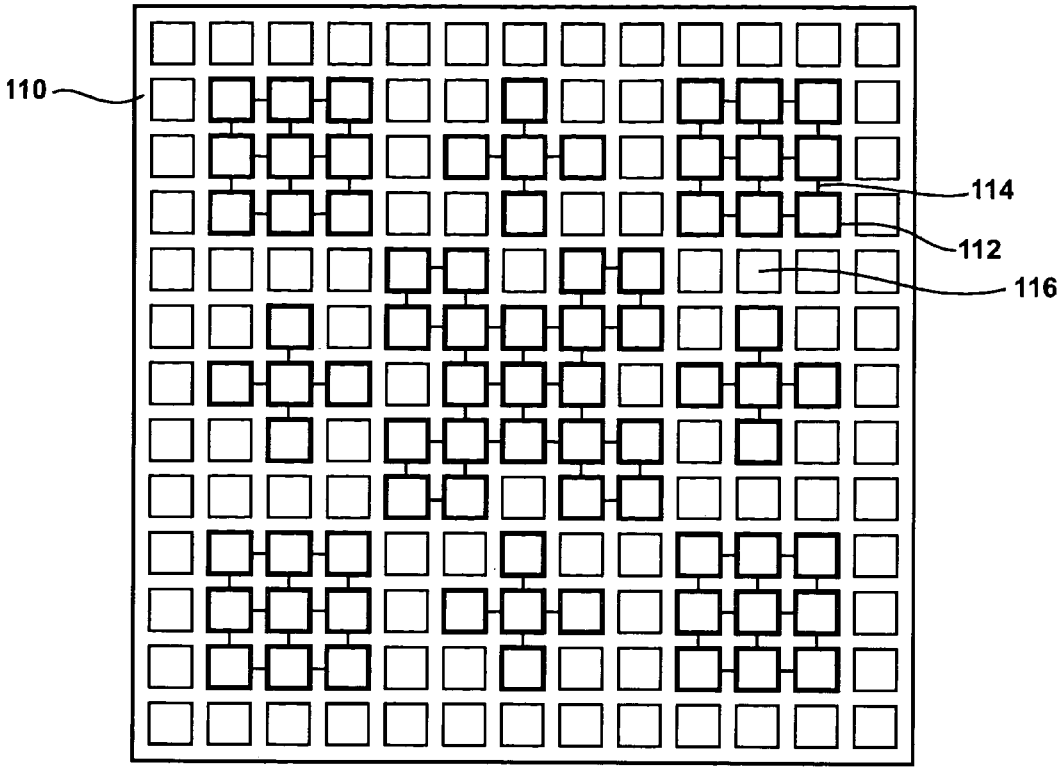
FIGS. 5A and 5B illustrate arbitrary states of interconnected pixels.
Figure 5B:
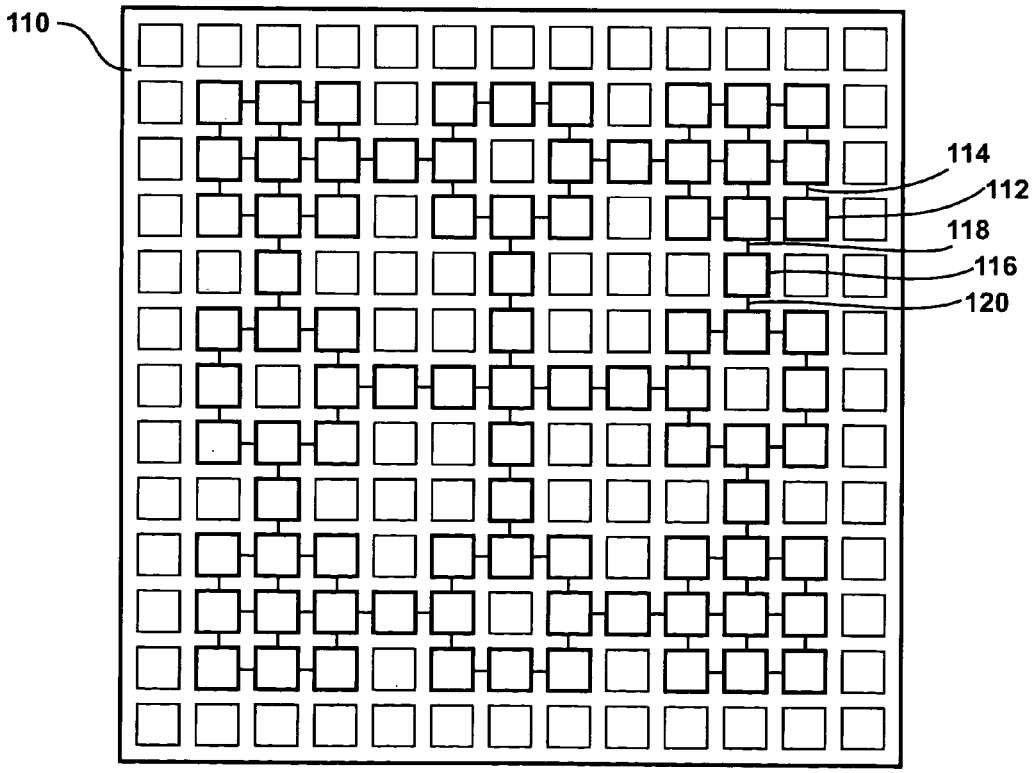

FIGS. 5A and 5B show two out of many possible arbitrary pixelization states that can be used for achieving different operating characteristics for a reconfigurable AMC ground plane, comprising pixels such as 112 supported on the surface 110 of a dielectric slab.

FIG. 5A shows a first arbitrary state, including pixel 112 which is interconnected to an adjacent pixel through closed switch 114, and pixel 116 which is not interconnected to any adjacent pixel. For illustrative convenience, pixels interconnected with at least one adjacent pixel are shown as a dark square; other pixels are shown as a light square.

FIG. 5B shows a second arbitrary state. Here, pixel 116 is electrically interconnected with two adjacent pixels through closed switches 118 and 120.

Any desired predetermined pattern of interconnected pixels can be provided. This example demonstrates the versatility that can be achieved by incorporating a pixelized FSS into the design of a reconfigurable AMC ground plane.

FIG. 6 shows a single radiative element of an antenna, considered from the standpoint of the RF characteristics of the radiative element and its connections to other radiative elements.

The radiative element includes first resonant circuit 144, second resonant circuit 132, radiative patch 134, variable capacitor 136, third resonant circuit 138, second variable capacitor 140, and RF input 142.

Tunable elements (such as tunable capacitors) can be used to tune the local frequency characteristics of the radiative element, the local phase, and interconnections with other elements. Three interconnections are shown; fewer (such as 1 or 2) or more (such as 4 or more) are also possible.

A resonant circuit can act as a switch, having open circuit properties at certain frequencies, and closed switch properties over other frequencies. Tunable elements can be used to adjust the frequency-dependent characteristics. Other switches can be used, such as MEMS devices, transistors, and the like.

Reconfigurable antennas are more fully described in a co-pending application, filed Nov. 13, 2003, to Jackson. For example, individual radiative elements, the connections of individual radiative elements to other radiative elements, and optionally the local phase of individual elements or groups of elements, or any combination of these may be varied and controlled using tunable dielectric elements.

Such reconfigurable antennas can be used in conjunction with reconfigurable AMC backplanes, as is described in more detail below.

FIG. 7 shows a small portion of an array of radiative elements, from the standpoint of the RF characteristics of the radiative elements and interconnections to other radiative elements. A single radiative element is shown at 150, and an inter-element coupling, typically including a resonant circuit, is shown as a sequence of dots 152. The figure shows the antenna elements, but does not explicitly show the connections to other elements or of the antenna element connection to antenna feed points. Connections to other elements can be made using single or multiple LC networks that provide connection or isolation depending on the tuning of the tunable capacitor.

Reconfigurable Antenna with Reconfigurable AMC

A reconfigurable antenna, for example as described in a co-pending U.S. Pat. application, filed Nov. 13, 2003, to Jackson, can be used in conjunction with a reconfigurable AMC backplane, as described herein, to provide an antenna system having widely adjustable characteristics, as will be clear to those skilled in the electrical arts.

For example, changes in the configuration of radiative elements of an antenna, which may for example be accompanied by a frequency change of the antenna radiation, can be accompanied by a change in the configuration of a reconfigurable AMC, for example to adjust a resonance frequency to match the new antenna frequency.

Switches

Conducting patches can be selectively interconnected using MEMS switches, transistors (such as thin film transistors), other semiconductor devices, photoconductors (and other optically controlled switches), other approaches known in the electrical arts, or a combination of methods.

As the term is used herein, a selected switch is substantially equivalent to a closed switch. Switches can be selected using electrical signals, magnetic fields, electromagnetic radiation (including light), thermal radiation, mechanical effects (such as actuation), vibrations, mechanical reorientation, or other method.

For example, transistors can be used to provide selectable electrical interconnections between conducting patches, so as to provide a reconfigurable frequency selective surface. As is well known, a transistor can be operated as a switch, providing effectively an open circuit or closed circuit between two transistor terminals, determined by the presence or otherwise of an electrical signal at a third terminal.

Transistors or other switching devices can also be used to modify the properties of tunable resonant circuits, which as described below can be used to provide controllable electrical interconnections between conducting patches.

MEMS devices can also be used as switches, for example as described in U.S. Pat. No. 6,469,677 to Schaffner et al. MEMS switches can comprise semiconductors such as silicon, oxides, conducting films such as metal films, dielectric materials, and/or other materials, as are known in the art.

Conducting Patches

An FSS can have a plurality of square or rectangular conducting patches arranged in a square or rectangular grid, selectively interconnectable using switches. However, other shapes of conducting patches, and other interconnection arrangements are possible.

For example, the unit cell of an FSS can have a configuration of permanently interconnected pixels, for example by providing metal or other conducting strips between conducting patches, or through provision of any desired conducting pattern. Switches can be provided to selectively interconnect one or more other conducting regions within the unit cell so as to achieve another configuration. For example, each unit cell of an FSS (or some number thereof) can be provided with a first conducting region, a switch, and a second conducting region, the two conducting regions being electrically interconnected when the switch is selected.

Electrically conducting patches for a reconfigurable FSS can comprise metal (such as copper, aluminum, silver, gold, alloy, or other metal), conducting polymer, conducting oxide (such as indium tin oxide), conducting (e.g. photo-excited or doped) semiconductor material, or other material. Electrical conducting materials are well known in the materials science arts.

The conducting patches can be of identical shape and size and be distributed uniformly over a surface of the dielectric layer, or may vary in shape, size, and/or distribution parameter (such as spacing). For example, circular, triangular, polygonal, or other shaped patches may be used. The patches may have some three-dimensional character, for example through curvature, if desired.

Dielectric Layer

A number of dielectric layer materials are known in the art. The dielectric layer may comprise a plastic film or sheet (for example, as used for printed circuit boards), a glass or ceramic layer, foam, gel, liquid, gas (such as air), or other non-conducting material. The dielectric layer may include multiple components, for example a tunable dielectric material in a sandwich or other structure with a conventional (i.e. non-tunable dielectric) plastic film.

A dielectric layer within an AMC may have an adjustable thickness, so as to provide further tuning of a resonance frequency. Electrically tunable dielectrics may be provided so as to allow local tuning of a resonance frequency within a portion of the AMC, for example to compensate for manufacturing irregularities, or to provide an AMC having portions with different resonance frequencies.

Electrical Addressing

Arrays of transistors or other switches can be electrically addressed using methods known in the art. For example, an array of thin film transistors can be controlled using matrix addressing techniques well known in relation to the matrix addressing of active matrix liquid crystal displays.

Addressing circuitry (or other switching circuitry) can in whole or in part be supported on the same surface of the dielectric layer as the conducting patches (for example, along side or underneath conducting patches), on the other surface of the dielectric layer (for example, connected to the conducting patches through conducting vias extending through the dielectric layer), on the other side of the conducting sheet (with appropriate connections), or elsewhere (for example, proximate to one or more edges of the dielectric layer, possibly in a region without conducting patches).

Crossed stripe patterns of electrodes, similar to those used in liquid crystal displays, can be used to apply addressing signals, along with transistors (such as thin film transistors) or diodes, storage capacitors, resistors, and other components, which can be designed using principles analogous to those used in active matrix liquid crystal displays. Electrodes can be supported by the dielectric layer, and may also be patterned into conducting layers proximate to the dielectric layer.

Such matrix addressing methods can also be used to locally adjust the dielectric constant of portions of the dielectric layer, for example by providing an electrically tunable dielectric as at least part of the dielectric layer.

Tunable Elements

A reconfigurable FSS can include tunable elements. For example, referring back to FIGS. 3A-3C, resonant circuits can be used to provide interconnections that are equivalent to open switches at one frequency, and equivalent to closed switches at another frequency. For example, a first pattern of interconnected conducting patches can be obtained at a first frequency, and a second pattern of interconnected conducting patches can be obtained at a second frequency. The frequency-dependent properties of a resonance frequency can be modified using a tunable capacitor and/or tunable inductor. Hence, the pattern of effective electrical interconnections at a given frequency can be modified by changing the resonance frequency of resonant circuits.

A transistor or other device (such as a digital or analog integrated circuit) can also be used to control an electric signal provided to one or more tunable elements, for example a tunable capacitor, so as to adjust the characteristics of the tunable element.

A variety of tunable elements or combinations of tunable elements can be used in a reconfigurable FSS or AMC, and/or also within a reconfigurable antenna. These include tunable capacitors and/or inductors, variable resistors, or some combination of tunable elements. A control electrical signal sent to a tunable element within an AMC backplane or portion thereof can be correlated with an electrical signal sent to a radiative element of an antenna (for example, a frequency tuning element).

Approaches to tunable capacitors include MEMS devices, tunable dielectrics (such as ferroelectrics or BST materials), electronic varactors (such as varactor diodes), mechanically adjustable systems (for example, adjustable plates, thermal or other radiation induced distortion), other electrically controlled circuits, and other approaches known in the art.

Tunable dielectrics can provide wide tunability, compatibility with thin film electronics technology, and potentially very low cost. Currently available tunable dielectrics, for example barium strontium titanate (BST), can provide greater than 80% dielectric constant tunability with loss characteristics useful for applications up to about 10 or 20 GHz. Other materials promise similar tunability with low-loss characteristics for frequencies approaching the THz range and with improved temperature stability compared to BST.

Hence, a pixelized frequency selective surface for reducing electromagnetically induced surface currents in an AMC ground plane can comprise a plurality of distributed pixels, at least some of the distributed pixels having one or more tunable capacitors, the pixels being selectively interconnectable to form a desired configuration of interconnected conducting patches. Each tunable capacitor can have a surface disposed in a defined plane, the corresponding plurality of surfaces of the plurality of pixels defining the ground plane. The one or more tunable capacitors may optionally further comprise a transistor.

In other examples, the electrical interconnection of pixels within an AMC ground plane, and optionally the local phase of antenna radiative elements or groups of elements, or any combination of these, may be varied and controlled using tunable dielectric elements.

Resistive elements can also be switched in and out of a reconfigurable conducting pattern or associated tuned circuit (such as described above) so as to provide controllable bandwidth, loss, or other electrical parameter.

Local Adjustments

The resonance frequency of a FSS, and an AMC containing an FSS, is sensitive to manufacturing parameters. Hence, conventional AMCs are manufactured with precision, so as to ensure a uniform resonance frequency over the entire extent of the AMC. Also, conventional approaches to adjusting an AMC may not allow compensation for local irregularities and distortions. Such restrictions seriously limit the applications of AMCs.

However, a reconfigurable AMC according to the present invention can be fabricated having significant local irregularities (for example in dielectric layer thickness), which then can be compensated for using local adjustments.

For example, a tunable element such as a tunable dielectric layer may be provided and adjusted to compensate for a manufacturing irregularity. Hence, uniformity across the AMC can be achieved, and initial manufacturing tolerances can be greater than would be suggested by the prior art.

In one example, a portion of an AMC proximate to a radiative element of the antenna can be individually adjusted. An antenna is provided with an AMC back plane, and each radiative element of the antenna is proximate to a portion of the AMC comprising a sub-array of FSS unit cells. The sub-array may be, for example a single unit cell, or a 2×2, 3×3, 4×4, 5×5 or other square, rectangular, or other sub-array of FSS unit cells. The properties of the sub-array can be locally adjusted, for example by providing electrical adjustment of a dielectric layer over the extent of the sub-array, reconfiguration of electrical interconnections, adjustment of resonant circuits, or other method or methods.

Local adjustments of a reconfigurable AMC can also be used in beam steering and beam conditioning applications. For example, sub-arrays proximate to a radiative element can be controlled so as to provide a desired radiated phase. Once radiative phase is controlled, beam steering and other beam conditioning methods are possible, as is known in the art.

In another example, a reconfigurable AMC can comprise a dielectric layer supporting an FSS, the dielectric layer being adhered or otherwise supported by a conducting surface, which may for example be part of another object, such as a metal housing or metal panel of a vehicle. Hence, a reconfigurable FSS supported by a dielectric layer can be adhered to an object, such as a vehicle or projectile, and local adjustments provided so as to achieve a substantially uniform property.

A reconfigurable AMC can also be located in a hostile environment, for example subject to temperature changes, and local adjustments used to compensate for variations due to ambient conditions.

In a further example, a reconfigurable FSS can be used in an AMC used as a backplane for a plurality of antennas. For example, an antenna array may comprise antennas having different operating frequencies, or adjustable frequencies. Regions of a reconfigurable FSS proximate to each antenna can be configured to have the appropriate resonance frequency for the operating frequency of the proximate antenna.

For example, a reconfigurable FSS may have a plurality of sub-regions which can be independently configured to provide an adjustable resonance frequency within each sub-region. This may be useful, for example, within a backplane for a plurality of antennas having different transmit and receive frequencies, as the sub-region of the AMC backplane can be configured on demand for a desired resonance frequency.

Hence, the properties of different sub-regions of a FSS can be independently controlled, and a backplane provided for an antenna or antenna array that can have controllable reflection phase properties. Portions of the backplane can act as a perfect magnetic conductor at one or more predetermined frequencies, other portions can have different properties. This allows optimized antenna operation, and also beam-forming and beam-steering applications.

One approach is to provide a different repeating unit cell over different portions of the FSS. Other approaches can also be used, either alone or in combination.

For example, an AMC may comprise a conducting backplane, a dielectric layer, and a FSS supported by the dielectric layer. The dielectric constant of individual regions of the dielectric layer can be controlled by an externally applied electric field. For example, the dielectric layer may comprise a voltage-tunable dielectric, for example a multilayer structure including a conventional dielectric (substantially non-voltage tunable), and a layer of tunable dielectric material. For example, an electric potential can be applied between interconnected conducting patches and the conducting backplane.

Fractal Tile Arrays

The present invention may also be employed in connection with self- similar fractal arrays and fractal tile (fractile) arrays such as Peano-Gosper fractal tile arrays, for example as described in U.S. application Ser. No. 10/625,158, filed Jul. 23, 2003. The elements can be uniformly distributed along a self-avoiding Peano-Gosper curve, which results in a deterministic fractal tile array configuration composed of a unique arrangement of parallelogram cells bounded by an irregular closed Koch curve. One of the main advantages of Peano-Gosper fractal tile arrays is that they are relatively broadband compared to conventional periodic planar phased arrays with regular boundary contours. In other words, they possess no grating lobes even for minimum element spacings of at least one-wavelength.

Such arrays are described in more detail in a co-pending U.S. patent application. In certain antenna configurations, described in the co-pending application, a reconfigurable AMC ground plane would allow beam steering over the whole hemisphere, allowing beam steering down to the horizon.

Techniques described herein can also be used to provide a reconfigurable fractal antenna, for example by providing selectable interconnections between conducting patches appropriately shaped and positioned so as to allow one or more fractal antenna patterns to be configured.

Genetic Algorithms

The use of genetic algorithms to design patch shapes for antennas is described in our co-pending applications, and in "Genetically engineered multi-band high-impedance surfaces", Kern et al., *Microwave Opt. Technol. Lett.*, 38(5), 400-403 (2003), and "A genetic algorithm approach to the design of ultra-thin electromagnetic bandgap absorbers", D. J. Kern and D. H. Werner, *Microwave Opt. Technol. Lett.*, 38(1), 61-64 (2003). Genetic algorithms are also described in U.S. Pat. App. Pub. Ser. No. 2004/0001021 to Choo et al., and elsewhere.

Genetic algorithms can be used to derive a number of unit cell configurations, for example so as to provide desired operation at one or more frequencies. The unit cell configuration of a pixelized FSS can then be changed between one or more of the desired configurations using methods described elsewhere in this specification.

Curved, Flexible, and Other Conformations

A reconfigurable FSS can be provided having curved or other three-dimensional surface profile, or as part of a flexible structure.

For example, a reconfigurable AMC can comprise a flexible dielectric layer (such as a polymer film), having a flexible conducting layer on one surface, and a reconfigurable FSS on an opposed surface. The conducting patches can be a flexible conductor. Flexible conductors are well known in the art, and include conducting polymers and metal foils. Optionally, the conducting patches can be substantially non-flexible, the structure flexing within regions between conducting patches, and/or between unit cells of the FSS. The switching devices used in a flexible reconfigurable FSS can include thin film transistors, for example, polysilicon thin film transistors have been used in flexible liquid crystal displays.

A reconfigurable AMC can have an arbitrary curved profile, for example so as to match the outer surface of a vehicle, electronic device, or other device. The curved profile can be permanent, or may be provided by conforming a flexible device to a curved profile. A flexible dielectric layer can support a reconfigurable FSS, with the flexible dielectric layer being conformed with and proximate to an existing curved metal surface so as to provide, for example, an AMC.

Other Applications

A reconfigurable FSS can be used in an electromagnetic reflector, for example to focus or otherwise control beams of electromagnetic radiation. A reconfigurable FSS can also be used in an electromagnetic absorber. The resonance frequency of an AMC having a reconfigurable FSS can be adjusted to provide the required absorption or reflection properties. For example, the use of an AMC as a metaferrite is described in co-pending U.S. patent application Ser. No. 10/755,539, filed Jan. 12, 2004, and a reconfigurable FSS can be used to optimize or otherwise spatially modify metaferrite behavior of an AMC. Further, a reconfigurable FSS can provide a surface having selected regions having a desired property, one or more other selective regions providing another property. For example, a reflecting region can be bounded by an absorbing region.

For example, a reconfigurable FSS can be provided on an object, such as a vehicle, and configured so that a sub-region of the FSS acts as a reflector, and another sub-region acts as an absorber. Hence, the apparent dimensions of the object (if any), as determined by radar, can controlled. Further, the local adjustment capabilities of an FSS can be used, for example while under radar surveillance, to minimize radar reflectivity. Further, different adjustment parameters can be stored in a memory for use in different conditions to maintain minimum radar reflectivity, for example adjustment parameters can be correlated with temperature, humidity, rain or dry conditions, object speed and orientation, and the like. Adjustment parameters may include electrical signals provided to switches and/or tunable elements, for example as described in more detail above.

Adjustments to an FSS can be made while a source of power is available. The adjustments may then be stored for a period of time after the power is removed. For example, tunable dielectrics can be tuned by electrical potentials stored on low-leakage capacitors.

A reconfigurable AMC can be used as a backplane for a low profile antenna, for example within a cell phone, wireless modem, pager, vehicle antenna, personal digital assistant, laptop computer, modem, other wireless receiver, transmitter, or transceiver, or other device.

Hence, by pixelizing the FSS used in an AMC ground plane, AMC ground planes can be provided that can be dynamically reconfigured for operation at any desired frequency, provided it lies between the lower and upper frequency limits of the design. These ground planes can be used in low-profile reconfigurable antenna systems. Applications include, but are not limited to, the development of new designs for low-profile multi-function frequency agile phased array antennas that have superior performance compared to conventional systems. The properties of these AMC ground planes can also be exploited to design frequency-agile phased array systems with wide-angle (e.g., hemispherical) coverage and reduced coupling due to the suppression of surface waves.

In one example, a dynamically reconfigurable AMC ground plane comprises a pixelized FSS. The pixelized FSS can be realized by interconnecting an N×N matrix of electrically small conducting patches by a sequence of switches that can be turned on and off to produce arbitrary periodic conducting patterns.

In another example, a pixelized FSS for reducing electromagnetically induced surface currents in a ground plane comprises a plurality of distributed pixels, each distributed pixel having one or more elements, the pixels being interconnected with each other to form an array and each element having a surface disposed in a defined plane, the corresponding plurality of surfaces of the plurality of pixels defining the plane. The elements may optionally comprise one or more resonant circuits.

The present invention may be employed in both the military and commercial sectors. Applications include, but are not limited to, the development of new designs for low-profile multi-function frequency agile phased array antennas that have superior performance compared to conventional systems.

Patents or publications mentioned in this specification are indicative of the levels of those skilled in the art to which the invention pertains. These patents and publications are herein incorporated by reference to the same extent as if each individual publication was specifically and individually indicated to be incorporated by reference. In particular, provisional application 60/462,719, filed Apr. 11, 2003, is incorporated herein in its entirety.

One skilled in the art will readily appreciate that the present invention is well adapted to carry out the objects and obtain the ends and advantages mentioned, as well as those inherent therein. The present methods, procedures, treatments, molecules, and specific compounds described herein are presently representative of preferred embodiments, are exemplary, and are not intended as limitations on the scope of the invention. Changes therein and other uses will occur to those skilled in the art which are encompassed within the spirit of the invention as defined by the scope of the claims.

Having described our invention, we claim:

1. A reconfigurable frequency selective surface (FSS) comprising:

a plurality of conducting patches supported on a first surface of a dielectric material; and a plurality of switches, each switch electrically interconnecting at least two of the plurality of conducting patches when the switch is selected, wherein a first ensemble of switches is selectable so as to provide a first configuration of electrically interconnected conducting patches, and a second ensemble of switches is selectable so as to provide a second configuration of electrically interconnected conducting patches, the reconfigurable FSS being part of an artificial magnetic conductor (AMC) ground plane of an antenna, the AMC further including the dielectric material and an electrically conducting sheet on a second surface of the dielectric material.

2. The reconfigurable FSS of claim 1, wherein the first configuration of electrically interconnected conducting patches provides a first resonance frequency, and the second configuration of electrically interconnected conducting patches provides a second resonance frequency, each switch being equivalent to a closed circuit when the switch is selected each switch being equivalent to an open circuit when the switch is not selected, switches being selectable using electrical signals applied to the switches, the electrical signals not being applied to the conducting patches.

3. The reconfigurable FSS of claim 1, wherein the first configuration of electrically interconnected conducting patches comprises a repeated unit cell pattern of electrically interconnected conducting patches.

4. The reconfigurable FSS of claim 3, wherein the first configuration of electrically interconnected conducting patches comprises a two-dimensional array of unit cell patterns of electrically interconnected conducting patches.

5. The reconfigurable FSS of claim 1, wherein the plurality of conducting patches is disposed in a square or rectangular grid pattern on the first surface of the dielectric material.

6. The reconfigurable FSS of claim 1, wherein each conducting patch has a square or rectangular shape.

7. The reconfigurable FSS of claim 1, wherein the plurality of conducting patches is arranged in a plurality of fractal arrays.

8. The reconfigurable FSS of claim 1, wherein the FSS has a doubly periodic structure.

9. A reconfigurable frequency selective surface (ESS) comprising:

a plurality of conducting patches, the conducting patches being supported on a first surface of a dielectric material; and a plurality of switches, each switch electrically interconnecting at least two of the plurality of conducting patches when the switch is selected, the conducting patches being selectively electrically interconnected in an electrical interconnection configuration, the electrical interconnection configuration comprising a plurality of selected switches, each switch acting as a closed circuit when selected, and as an open circuit when not selected, switches being selected using electrical signals applied to the switches, the electrical signals not being applied to the conducting patches, wherein a resonance frequency of the frequency selective surface is adjustable through a modification of the electrical interconnection configuration, the reconfigurable FSS being part of an artificial magnetic conductor (AMC), the AMC further including the dielectric material and an electrically conducting sheet substantially adjacent to a second surface of the dielectric material, the electrically conducting sheet being a continuous sheet opposing the plurality of conducting patches.

10. The reconfigurable FSS of claim 9, wherein the FSS provides a first resonance frequency corresponding to a first electrical interconnection configuration, and a second resonance frequency corresponding to a second electrical interconnection configuration, wherein the first electrical interconnection configuration and the second electrical interconnection configuration are electrically selectable.

11. The reconfigurable FSS of claim 10, wherein the first resonance frequency is an integer multiple of the second resonance frequency.

12. The reconfigurable FSS of claim 9, wherein the dielectric material is a dielectric layer.

13. The reconfigurable FSS of claim 12, the electrically conducting sheet being supported by the second surface of the dielectric layer.

14. The reconfigurable FSS of claim 9, wherein the ESS has a doubly periodic structure.

15. The reconfigurable FSS of claim 9, wherein the modification of the electrical interconnection configuration is achieved by providing electrical signals to an array of switches.

16. The FSS of claim 9, wherein the artificial magnetic conductor (AMC) is part of an electromagnetic reflector.

17. The FSS of claim 9, wherein the artificial magnetic conductor (AMC) is part of an electromagnetic absorber.

18. The FSS of claim 9, wherein the artificial magnetic conductor (AMC) is a ground plane for an antenna.

19. An artificial magnetic conductor (AMC), the AMC comprising:

a dielectric material having a first surface and a second surface;

a plurality of electrically conducting patches supported by the first surface of the dielectric material; and an electrically conducting sheet substantially adjacent to the second surface of the dielectric material, the electrically conducting sheet being a continuous sheet opposing the plurality of conducting patches, wherein the electrically conducting patches have an electrical interconnection configuration comprising electrical switches, the electrical interconnection configuration being reconfigurable through selection of one or more of the electrical switches so as to change a resonance frequency of the reconfigurable AMC, the reconfigurable AMC behaving as a magnetic conductor at the resonance frequency, wherein the electrical switches each comprise a transistor.

20. The AMC of claim 19, wherein the electrical interconnection configuration comprises a repeated pattern of unit cell interconnection configurations.

21. The AMC of claim 19, wherein the electrical interconnection configuration is reconfigurable using electrical signals applied to the transistors.

22. The AMC of claim 19, wherein the electrical interconnection configuration for incident electromagnetic radiation is reconfigurable through a change in the frequency of the incident electromagnetic radiation.

23. The AMC of claim 19, comprising a plurality of regions, the resonance frequency of at least one region being independently adjustable.

24. The AMC of claim 23, wherein the resonance frequency of each region is independendy adjustable.

25. The AMC of claim 23, wherein the AMC is a ground plane of an antenna.

* * * * *